US007108547B2

(12) United States Patent
Kisling et al.

(10) Patent No.: US 7,108,547 B2
(45) Date of Patent: Sep. 19, 2006

(54) HARDLINE COAXIAL CABLE CONNECTOR

(75) Inventors: Brian L. Kisling, Phoenix, AZ (US); Thomas D. Miller, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/865,314

(22) Filed: Jun. 10, 2004

(65) Prior Publication Data

US 2005/0277330 A1 Dec. 15, 2005

(51) Int. Cl.
*H01R 9/05* (2006.01)

(52) U.S. Cl. ..... 439/578

(58) Field of Classification Search ..... 439/578, 439/583–585

See application file for complete search history.

(56) References Cited

U.S. PATENT DOCUMENTS

| | | | | |
|---|---|---|---|---|
| 3,624,679 | A | 11/1971 | Ziegler, Jr. | |
| 3,963,321 | A * | 6/1976 | Burger et al. | 439/584 |
| 4,808,124 | A * | 2/1989 | Spinner et al. | 439/578 |
| 5,120,260 | A | 6/1992 | Jackson | |
| 5,647,119 | A | 7/1997 | Bourbeau et al. | 29/751 |
| 5,651,698 | A * | 7/1997 | Locati et al. | 439/578 |
| 5,997,350 | A | 12/1999 | Burris et al. | 439/585 |
| 6,102,738 | A * | 8/2000 | Macek et al. | 439/584 |
| 6,183,298 | B1 | 2/2001 | Henningsen | 439/578 |
| 6,322,390 | B1 | 11/2001 | Takeuchi | |
| 6,331,123 | B1 | 12/2001 | Rodrigues | 439/584 |
| 6,733,336 | B1 * | 5/2004 | Montena et al. | 439/578 |
| 6,790,081 | B1 * | 9/2004 | Burris et al. | 439/578 |

OTHER PUBLICATIONS

Corning-Gilbert, Inc., Product Information for Part No. GAF-US-11, Oct. 2002, 2 pages.
Corning-Gilbert, Inc., Installation Guide for Part No. GAF-UST-11, Apr. 2003, 2 pages.
CommScope Inc., Product Description QR320JCA, 75 Ohm Coaxial Cable, Aug. 14, 2003, 1 page.
International Search Report PCT/US2005/020358.

* cited by examiner

*Primary Examiner*—Briggitte Hammond
*Assistant Examiner*—X. Chung-Trans
(74) *Attorney, Agent, or Firm*—Joseph M. Homa; Marvin A. Glazer

(57) ABSTRACT

An axially-compressible connector (200) for a hardline coaxial cable (1000) has a housing that includes a body (202), a coupling nut (210) and a compression can (208). A nonmetallic sleeve (302), which is mounted within the housing, has a tubular portion and an integral insulator portion. The insulator portion holds a contact (306) that has arms (311–314) for seizing an inner conductor (1002) of the hardline coaxial cable. A ferrule (408) is slip fit mounted within the housing, and seizes an outer conductor (1006) of the hardline coaxial cable. A gripping member (414) is mounted within the housing and seizes a jacket (1008) of the hardline coaxial cable. An actuator (412), which is mounted within the housing around a portion of the tubular portion of the sleeve, has an angled surface (413) to guide an end of the outer conductor toward the tubular portion of the sleeve, as the tubular portion of the sleeve is inserted into the end of the coaxial cable. The jacket is gripped by the gripping member only after the outer conductor is seized by the ferrule.

5 Claims, 12 Drawing Sheets

200

HARDLINE COAXIAL CABLE CONNECTOR

BACKGROUND OF THE INVENTION

1. Field of the Invention

The present invention relates generally to electrical connectors, and more specifically to an axially-compressible electrical connector for use with a hardline coaxial cable.

2. Description of the Related Art

A hardline coaxial cable is a coaxial cable that has a solid, as opposed to a braided, outer conductor, which may be surrounded by an outer insulative jacket. One such hardline coaxial cable is the QUANTUM REACH® coaxial cable, catalog number QR320, which has a solid aluminum outer conductor and a solid copper clad aluminum inner conductor, and which is manufactured by CommScope Inc., of Hickory, N.C. A popular style of coaxial cable connector is a male, F-type axially-compressible connector. Prior to attaching such a hardline coaxial cable to such a connector, a coaxial cable coring tool is used to remove a predetermined amount of the dielectric material between the inner and outer conductors at a terminating end of the hardline coaxial cable, and to trim the jacket in order to bare the outer conductor a predetermined amount. The end of the outer conductor of the coaxial cable can become deformed while using the coring tool. Such deformation is usually flaring, which is slightly increasing the diameter of the outer conductor, or producing a slight octagonal shape to the end of the outer conductor. Known F-type connectors for such a hardline coaxial cable will sometimes not properly accept insertion of the coaxial cable due to such deformation of the end of the outer conductor.

Known F-type connectors for hardline coaxial cable have a metal sleeve within a housing. When the coaxial cable is inserted into such an F-type connector for attachment thereto, the inner conductor of the coaxial cable fits into the metal sleeve and the outer conductor envelopes the metal sleeve. Traditionally, such sleeves are made from metal in order to have strength. However, the metallic nature of such sleeves disadvantageously alters the characteristic impedance of the connector-coaxial cable combination from its nominal seventy-five (75) ohms. Known F-type connectors also have an insulator around a conductive center contact that holds the center contact to the housing of the connector. Because the sleeve and the insulator of known F-type connectors are made of different materials, the sleeve and the insulator must be separate components, thus disadvantageously increasing the number of components in the connector.

Coaxial cable connectors can be categorized by the action required to complete the attachment and to effect a permanent electrical and mechanical connection and/or seal between components of the connector. One style of connector is a threaded style. Another style of connector is a crimping style. A yet another style of connector is a compression style, which is axially-compressible.

The compression style of connector has a housing comprising at least two large parts, typically with an O-ring seal therebetween, which are axially compressed with a hand tool after the coaxial cable is inserted into the connector. One or more internal components, internal to the housing, are radially displaced toward the outer conductor by the axial compression. The one or more internal components are intended to securely engage and make an electrical connection with the outer conductor, and to engage the outer insulation, or jacket, of the coaxial cable.

FIG. 1 is a cross-sectional view of a known prior art male, F-type, compression style of connector 100 for use with a coaxial cable having a braided outer conductor, part number GAF-US-11, manufactured by Corning-Gilbert, Inc., of Glendale, Ariz., which performs its intended function well, but which is not intended for use with a coaxial cable having a solid outer conductor.

Compression style connectors that have internal gripping parts that seize the inner and outer conductors are well known. Some compression style connectors also seize the jacket. Known compression style connectors that seize both the outer conductor and the jacket do so substantially simultaneously as the connector is compressed. With such compression style connectors, the cable may disadvantageously have some relative motion with respect to the connector when the jacket gripping part attempts to seize the outer insulation of the coaxial cable. Known prior art compression style connectors that seize two or more portions of the coaxial cable simultaneously are disadvantageously difficult to compress.

OBJECTS OF THE INVENTION

It is therefore an object of the present invention to provide a connector that can accommodate a coaxial cable that has a deformed terminating end of the outer conductor.

Another object of the present invention is to provide a connector that can at least partially undeform the deformed terminating end of the outer conductor of the coaxial cable as the coaxial cable is inserted into the connector.

Yet another object of the present invention is to provide a connector that has a sleeve that does not adversely affect the characteristic impedance of the connector-coaxial cable combination.

A further object of the present invention is to provide a connector that has an integral, nonmetallic sleeve and insulator.

Yet a further object of the present invention is to provide a connector that is easier to compress.

Still another object of the present invention is to provide a connector that grips the outer conductor prior to gripping the jacket.

Still a further object of the present invention is to provide a connector that grips the jacket when the cable has no relative motion with respect to the connector.

These and other objects of the present invention will become apparent to persons skilled in the art as the description thereof proceeds.

SUMMARY OF THE INVENTION

Briefly described, and in accordance with a preferred embodiment thereof, the present invention relates to a connector for terminating the end of a coaxial cable that has an inner conductor, an outer conductor, and an outer insulating jacket. The connector includes a substantially cylindrical body that has an axis, a front end and a back end, a coupling nut that is rotatably connected to the body at the front end of the body, a compression can that is axially movably connected to the body at the back end of the body, means for contacting the inner conductor of the coaxial cable, means for seizing the outer conductor of the coaxial cable, and means for gripping the insulating jacket of the coaxial cable. The seizing of the outer conductor and the gripping of the insulating jacket occur sequentially during compression together of the body and of the compression can after insertion of the termination end of the coaxial cable into the connector.

Another aspect of the invention relates to a connector for attachment to the end of a coaxial cable that has an inner conductor surrounded by a dielectric that is surrounded by an outer conductor. The outer conductor is surrounded by a jacket. The connector is generally cylindrical and has an axis. The connector includes a body that has a front end and a back end, a coupling nut that is rotatably connected to the body at the front end of the body, a first contact for contacting the inner conductor of the coaxial cable, a second contact for contacting the outer conductor of the coaxial cable, and a nonmetallic sleeve that is fixedly mounted within the body. The nonmetallic sleeve includes an insulator portion and an integral tubular portion. The integral tubular portion has an end adapted to be inserted into the end of a coaxial cable around at least a portion of the dielectric and within the outer conductor of the coaxial cable, and the insulator portion is adapted to hold the contact at the axis of the connector.

Still another aspect of the invention relates to a connector for attachment to the end of a coaxial cable that has an inner conductor surrounded by a dielectric that is surrounded by an outer conductor. The outer conductor is surrounded by a jacket. The connector is generally cylindrical and has an axis. The connector includes a body that has a front end and a back end, a coupling nut that is rotatably connected to the body at the front end of the body, means located within the connector for contacting the inner conductor of the coaxial cable, means located within the connector for contacting the outer conductor of the coaxial cable, and a sleeve that is fixedly mounted within the body. The sleeve includes a tubular portion that has an end adapted to be inserted into the end of a coaxial cable around at least a portion of the dielectric and within the outer conductor of the coaxial cable. The connector also includes an actuator that is mounted within the body around a portion of the sleeve. The actuator has an angled surface to guide an end of the outer conductor of the coaxial cable toward the tubular portion of the sleeve, as the tubular portion of the sleeve is inserted into the end of the coaxial cable.

Other aspects, features and advantages of the present invention will become apparent to persons skilled in the art from the following detailed description and the accompanying drawings. It should be understood however that the detailed description and specific examples, while indicating preferred embodiments of the present invention, are given by way of illustration only and various modifications may naturally be performed without deviating from the present invention.

BRIEF DESCRIPTION OF THE DRAWINGS

The present invention will be described with greater specificity and clarity with reference to the following drawings, in which.

Figure 1:
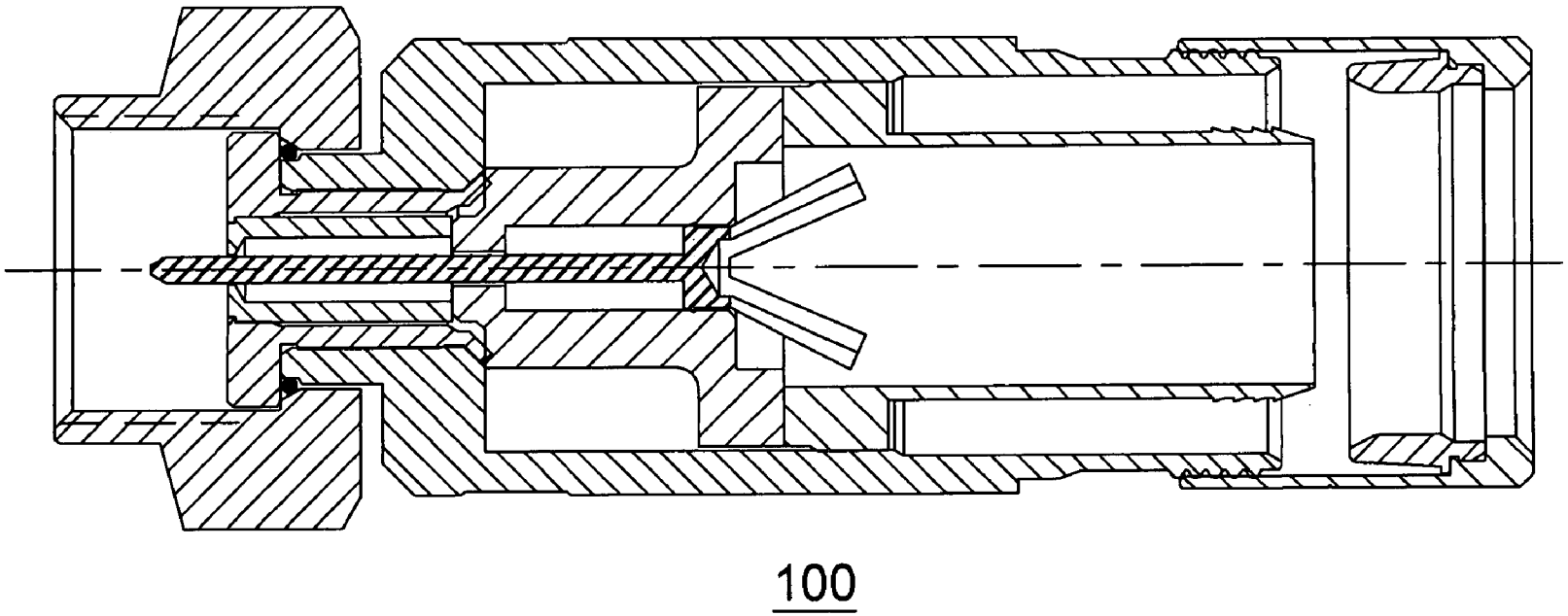
PRIOR ART FIG. 1
FIG. 1 is a cross-sectional view of a prior art compression style coaxial cable connector for use with braided coaxial cable.

For simplicity and clarity of illustration, the drawing figures illustrate the general manner of construction, and descriptions and details of well-known features and techniques are omitted to avoid unnecessarily obscuring the invention. Additionally, elements in the drawing figures are not necessarily drawn to scale.

DESCRIPTION OF THE PREFERRED EMBODIMENT

It should be understood that the embodiments discussed below are only examples of the many advantageous uses of the innovative teachings herein. In general, statements made in the specification of the present application do not necessarily limit any of the various claimed inventions. Some statements may apply to some inventive features but not to others. In general, unless otherwise indicated, singular elements may be in the plural and vice versa with no loss of generality. The terms first, second, third, and the like, in the description and in the claims, if any, are used for distinguishing between similar elements and not necessarily for describing a sequential or chronological order. The terms top, front, side, and the like, in the description and in the claims, if any, are used for descriptive purposes and not necessarily for describing relative positions.

Figure 2:
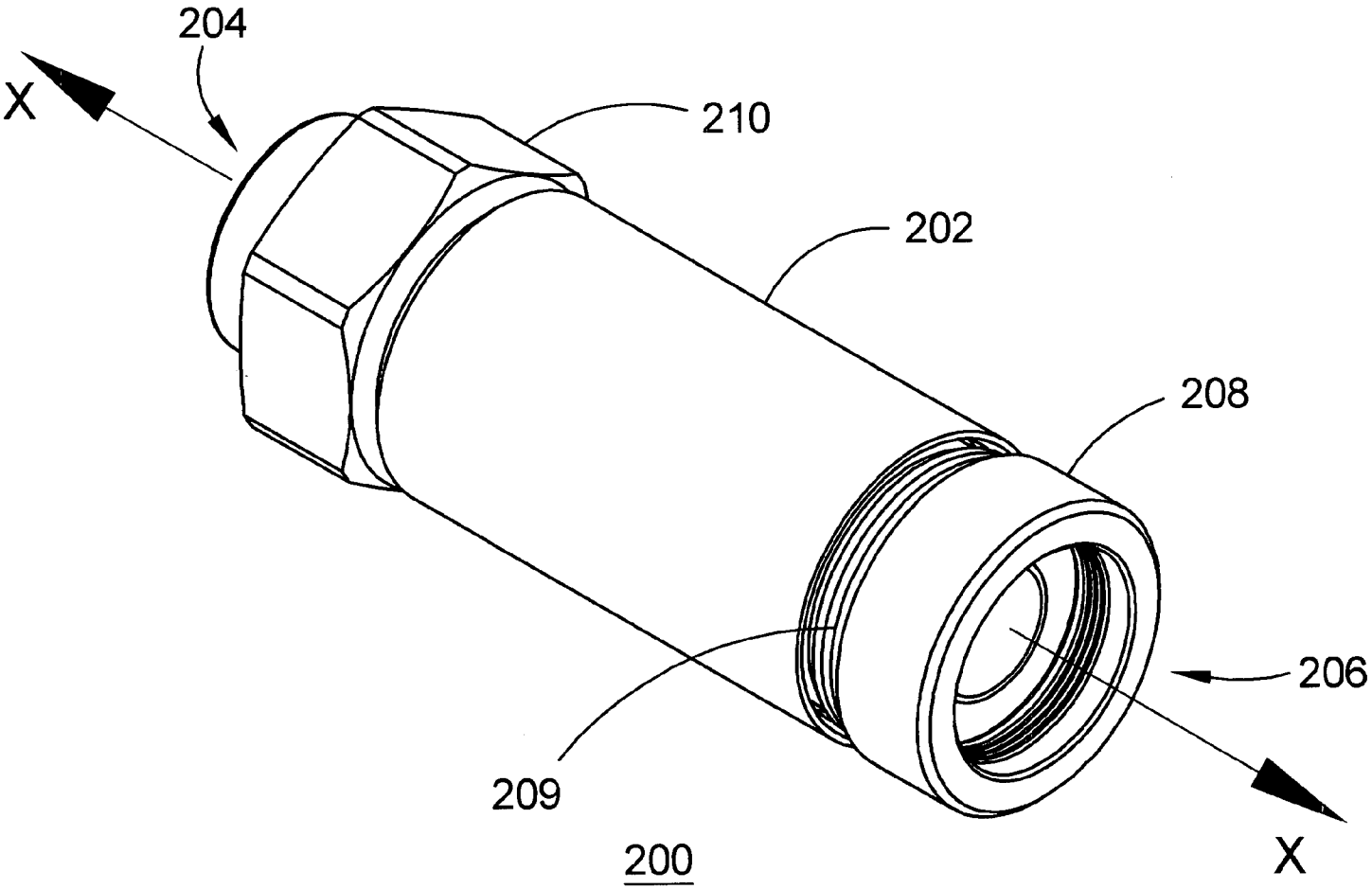
FIG. 2 is a perspective view of a connector in accordance with the invention.

FIG. 2 illustrates a perspective view of a male, F-type, compression style connector, constructed in accordance with the invention, and which is generally designated by reference numeral 200. The connector 200 can be used to couple an end of a hardline coaxial cable 1000 (see FIGS. 10–12) to a threaded port (not shown). One preferred coaxial cable is the QUANTUM REACH® coaxial cable model QR320. The coaxial cable 1000 comprises an inner conductor 1002 at the center of the coaxial cable, a dielectric 1004, an outer conductor 1006 and a jacket 1008. The connector 200 has a centerline along the axis X—X. The connector 200 has a front end 204 and a back end 206, at opposites ends of the connector along the centerline. The connector 200 comprises a generally cylindrical or tubular metallic body 202. The body 202 has a front end and a back end, at opposites ends along the centerline. A generally cylindrical or tubular metallic compression can 208, is connected to back end of the body 202, by a rear compression ring 209, for axial movement relative to the body from an uncompressed position shown in FIG. 2, to a fully compressed position shown in FIG. 9. The body 202 and the compression can 208 are press fitted onto the rear compression ring 209. A metallic coupling member, such as coupling nut 210, is rotatably connected to the front end of the body 202. Alternatively, another type of coupling member is used, such as a BNC interface. The coupling nut 210 has an internally threaded bore (not shown) for engaging an externally threaded port. The body 202, the compression can 208, the rear compression ring 209 and the coupling nut 210 are preferably made from a brass alloy.

Figure 3:
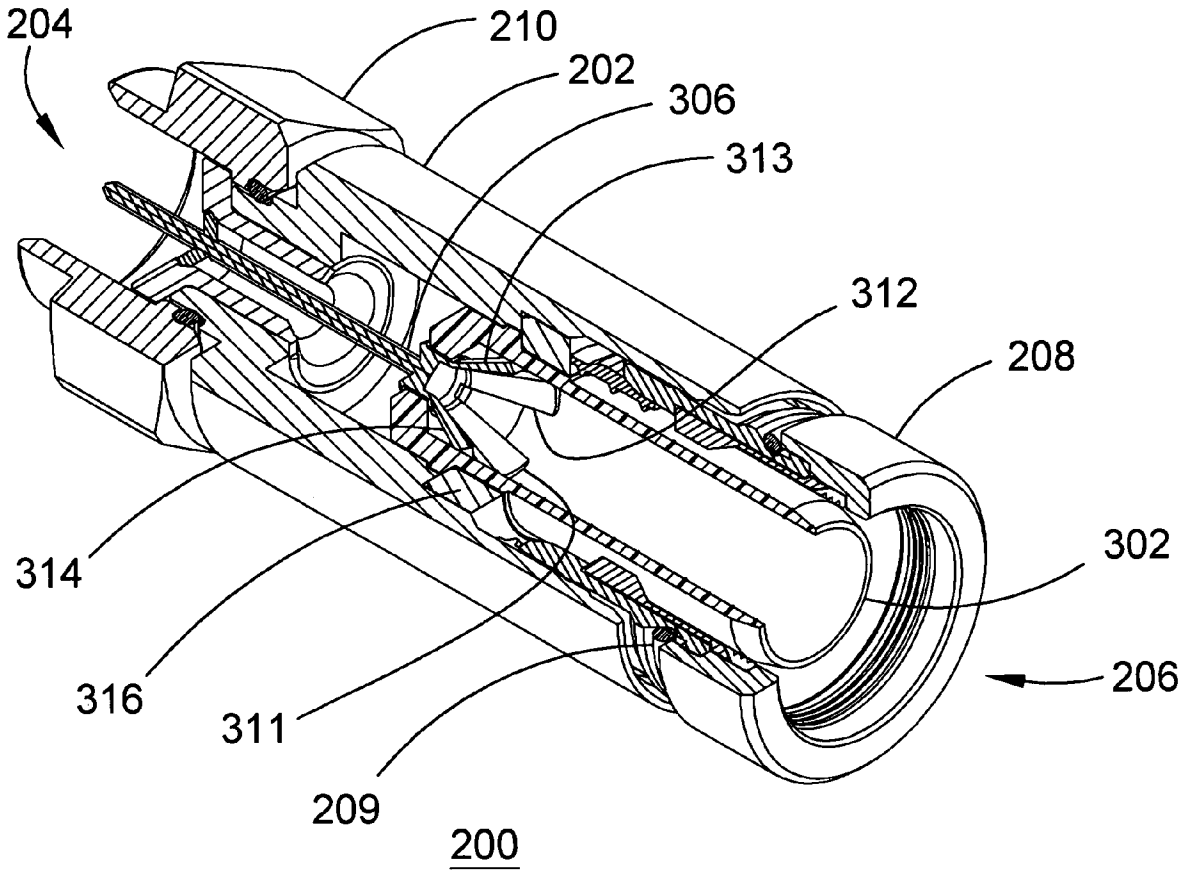
FIG. 3 is a cut-away view of the perspective view of the connector of FIG. 2.

FIG. 3 is a cut-away view of the perspective view of the connector 200 showing a nonmetallic sleeve 302, fixedly mounted within the body 202, preferably made from ULTEM®2200 glass filled polyetherimide manufactured by General Electric Company. The sleeve 302 has a generally cylindrical-shaped portion, somewhat resembling a tube, having an axis that coincides with the axis of the connector 200 and an integral front portion having a reduced-diameter opening, preferably a circular, with a center at the axis of the connector. The front portion of the sleeve 302 acts as an insulator for holding a back end of a metallic contact 306 at the axis of the connector. Because the sleeve 302 is nonmetallic, the sleeve advantageously does not adversely affect the characteristic impedance of the connector-coaxial cable combination. The contact 306 is preferably made from a brass alloy. The contact 306 has an elongate longitudinal portion, resembling a pin, and a back portion. The back portion of the contact 306 is mounted within the reduced-diameter opening of the sleeve 302. When mounted to the connector 200, as shown in FIG. 3, the elongate longitudinal portion of the contact 306 extends from the insulator portion of the sleeve 302 to the front end 204 of the connector 200. The back portion of the contact 306 includes four (4) arms 311–314 extending from the insulator portion of the sleeve 302 toward the back end 206 of the connector 200. Prior to being connected to the coaxial cable 1000, the arms 311–314 are spread within a portion of the space defined by the generally cylindrical-shaped portion of the sleeve 302, and the pin portion of the contact 306 is recessed within the coupling nut 210. Each of the arms 311–314 has a plurality of small teeth (not shown) on the surface of the arm facing the axis of the connector 200. The plurality of teeth on the arms 311–314 is used for more securely seizing the inner conductor 1002 of the coaxial cable 1000, as is more fully explained hereinbelow. The contact 306 can move axially through the circular opening in the insulator portion of the sleeve 302 during the process of the coaxial cable 1000 being attached to the connector 200. A metallic front compression ring 316 is mounted between the body 202 and the sleeve 302 by a press fit. Preferably, the front compression ring 316 is made from a brass alloy.

Figures 4, 13, 14:
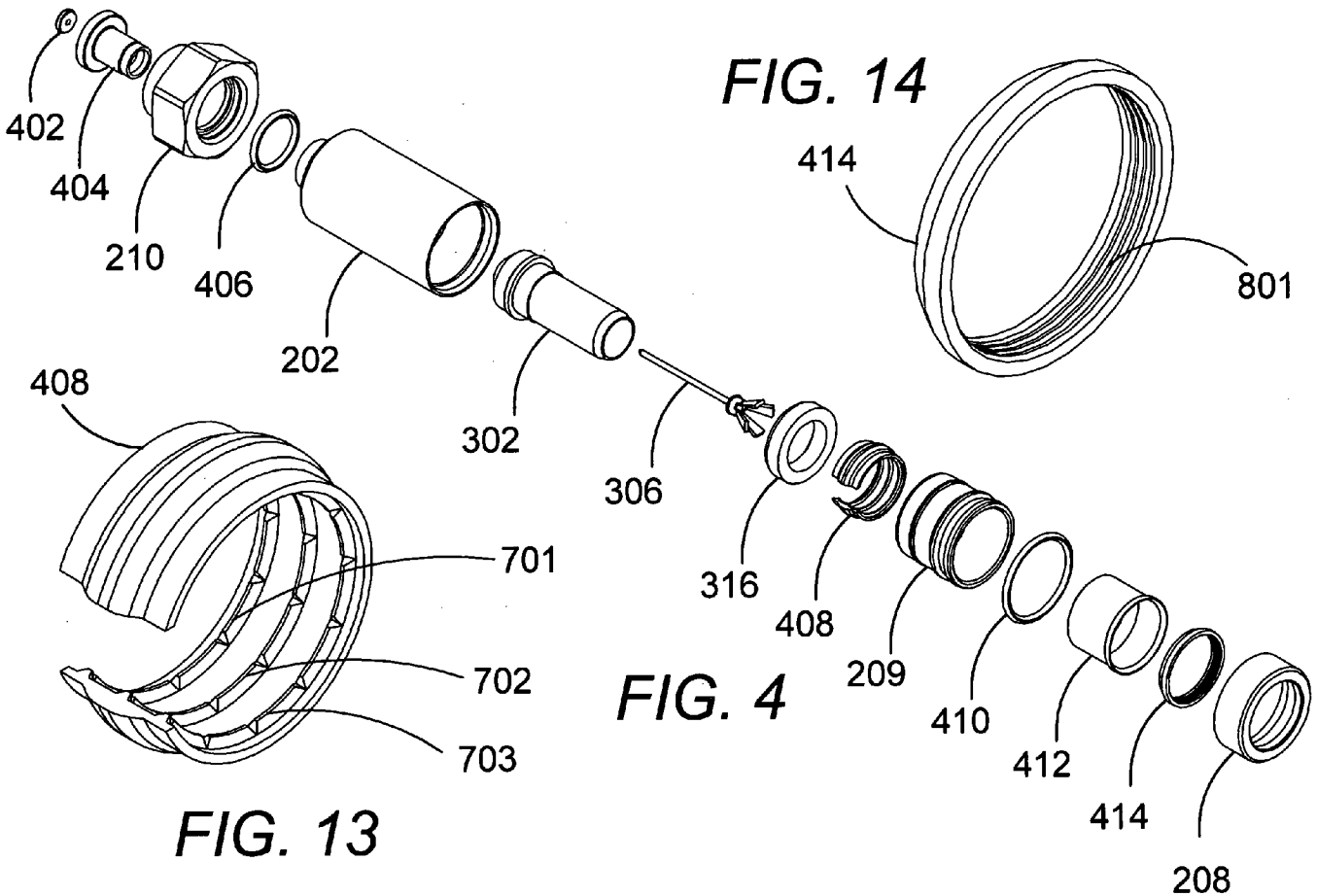
FIG. 4 is an exploded, perspective view of the connector of FIG. 2, including a ferrule and a gripping member.
FIG. 13 is an enlargement of the ferrule of FIG. 4.
FIG. 14 is an enlargement of the gripping member of FIG. 4.

FIG. 4 is an exploded, perspective view of the connector 200. The components of the connector 200 also comprise an insulator 402, a nut retainer 404, a front O-ring 406, a ferrule 408, a rear O-ring 410, an actuator 412, and a gripping member 414. The insulator 402 holds a front end of the contact 306 at the axis of the connector 200. The ferrule 408 is mounted within the body 202 by a slip fit and is held in place by the front compression ring 316. The insulator is preferably made from polytetrafluoroethylene. The front O-ring 406 and the rear O-ring 410 are preferably made from ethylene propylene. The gripping member 414 is plastic, so as not to deform the coaxial cable 1000 during the compression operation, and is preferably made from acetyl. The nut retainer 404 and the ferrule 408 are preferably made from a brass alloy.

Figure 5:
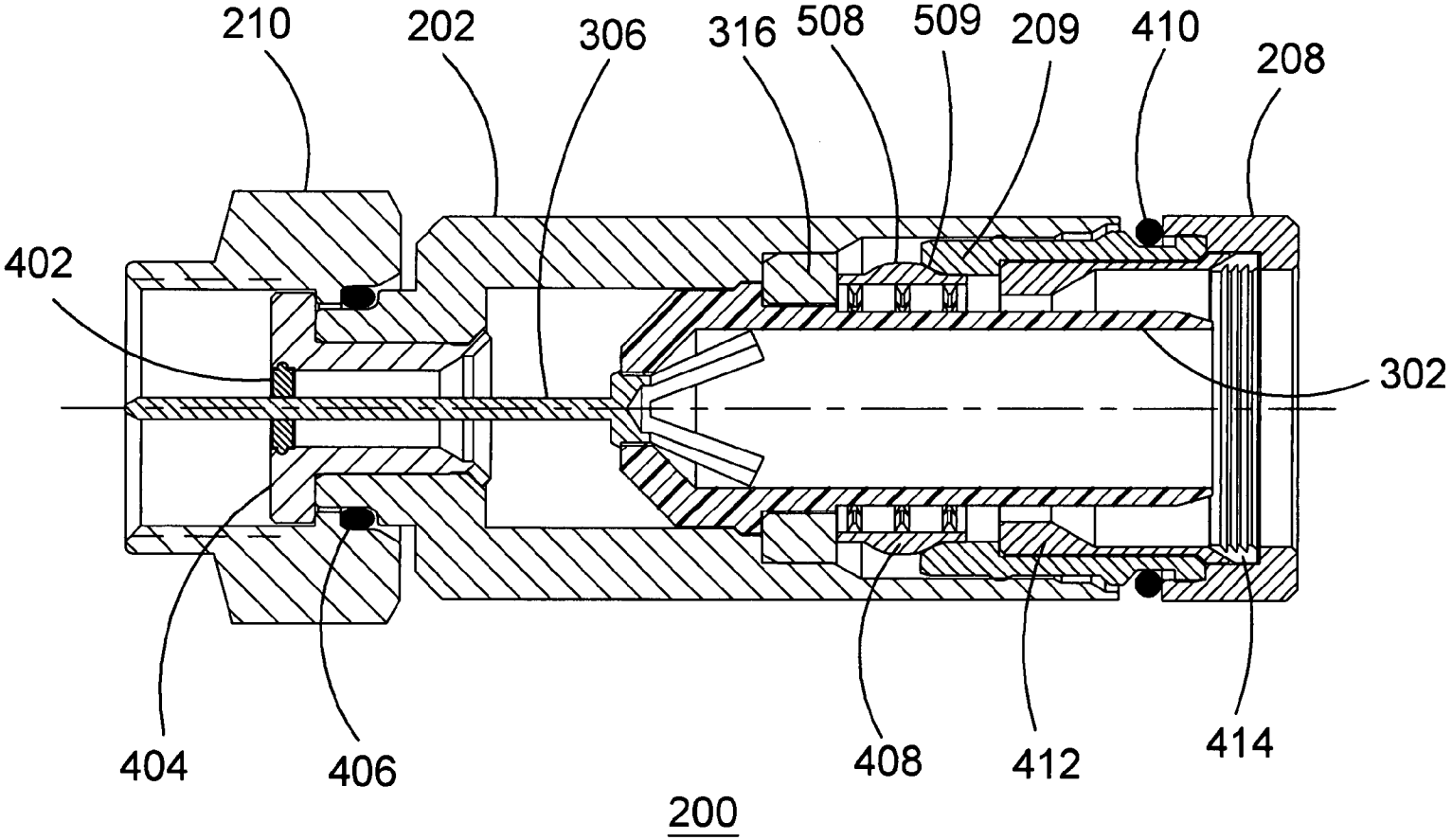
FIG. 5 is a cross-sectional view along cut-line X—X of the connector of FIG. 2.

FIG. 5 shows a cross-sectional view of the connector 200 prior to insertion of the coaxial cable 1000. In FIG. 5, the connector 200 is shown in an uncompressed state.

Figure 6:
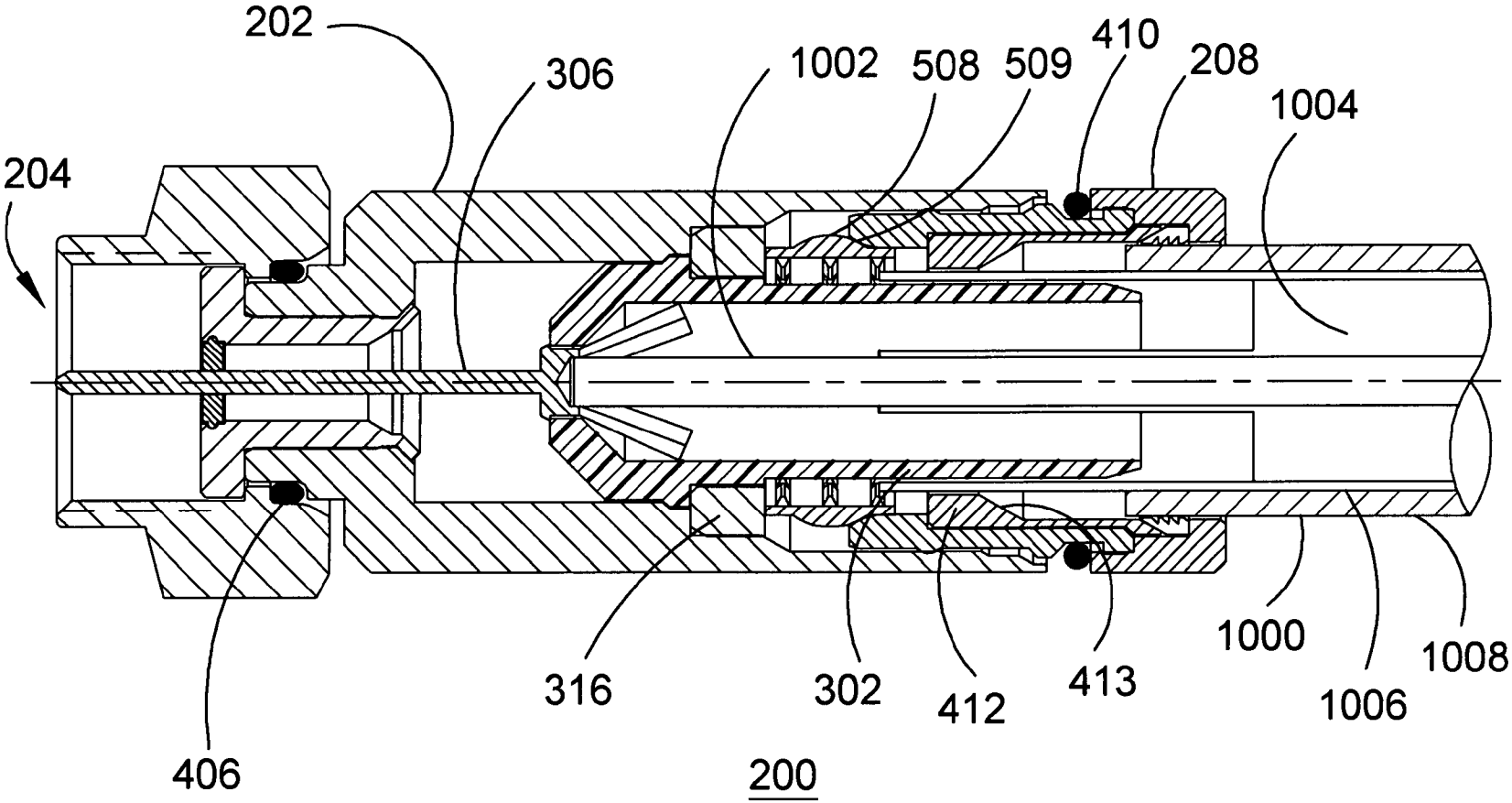
FIG. 6 is a cross-sectional view along cut-line X—X of the connector of FIG. 2, including a cross-sectional view of a hardline coaxial cable partially inserted into the connector.

Referring now to FIG. 6, which shows a cross-sectional view along cut-line X—X of the connector 200, including a cross-sectional view of the coaxial cable 1000 partially inserted into the connector. A first step in the attachment of the connector 200 to the coaxial cable 1000 is to use a standard, handheld coaxial cable coring tool to remove a predetermined amount of the dielectric 1004 between the inner conductor 1002 and the outer conductor 1006, and to trim the jacket 1008 in order to bare the outer conductor a predetermined amount. One of a Cablematic® model CST-GAF 320/7C QR coring tool manufactured by the Ripley Company of Cromwell, Conn., and a CablePrep® model SCT-F320QR coring tool manufactured by Ben Hughes Communications Products Company of Chester, Conn. is preferably used.

A second step in the attachment of the connector 200 to the coaxial cable 1000 is to insert (which is typically performed manually) the coaxial cable into the back end 206 of the connector until the inner conductor 1002 touches the contact 306. The actuator 412 has an internal angled surface 413 that is preferably at an angle of approximately 45° (relative to the direction of movement of the coaxial cable 1000 as it is inserted into the connector 200). If a coaxial cable 1000 is ideally prepared with a coring tool, the bared outer conductor 1006 of the coaxial cable passes between the sleeve 302 and the actuator 412 as the coaxial cable is inserted into the connector 200. Advantageously, the deformed outer conductor 1006 of a less than ideally prepared coaxial cable 1000 (see FIGS. 11 and 12) strikes the angled surface 413 and is at least partially undeformed, or re-formed, to an orientation more parallel to the centerline axis, by the angled surface as the coaxial cable is inserted into the connector 200. The angled surface 413 also guides the outer conductor 1006 to pass between the sleeve 302 and the actuator 412 when the outer conductor is inserted into the connector 200. FIG. 6 shows the coaxial cable 1000 partially inserted into the connector 200, after the second step. In the event that the outer conductor 1006 had been slightly deformed prior to insertion into the connector 200, the outer conductor 1006 would also appear as shown in FIG. 6 as a result of advantageously having become at least partially undeformed during the second step.

Figure 7:
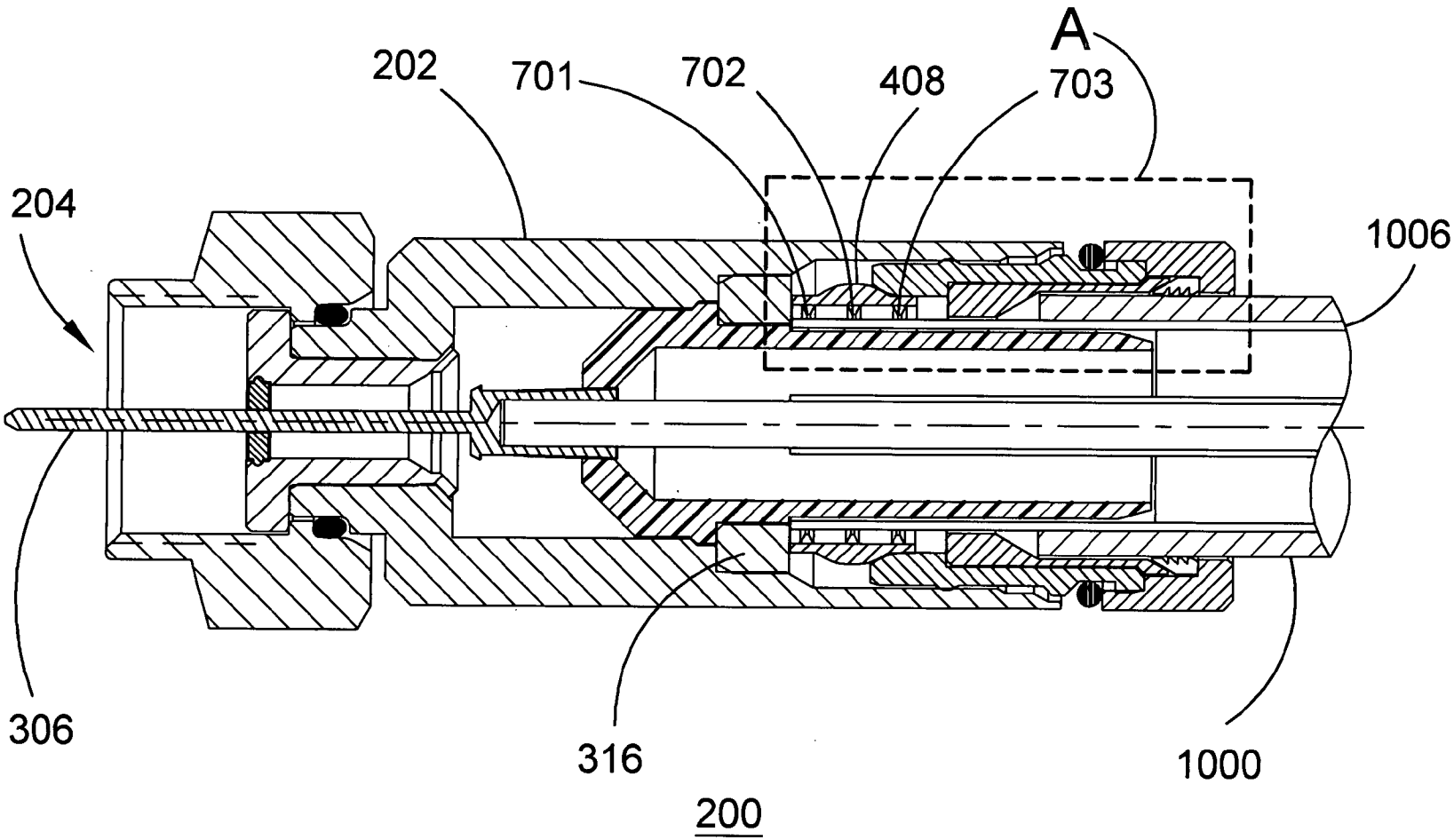
FIG. 7 is a cross-sectional view along cut-line X—X of the connector of FIG. 2, including a cross-sectional view of the hardline coaxial cable fully inserted into the connector.

Referring now to FIG. 7, a third step in the attachment of the connector 200 to the coaxial cable 1000 is to fully insert the end of the coaxial cable into the connector by continuing to insert the coaxial cable into the back end 206 of the connector, thereby forcing the contact 306 toward the front end 204 of the connector. As the contact 306 moves toward the front end 204, the arms 311–314 of the contact move through the reduced-diameter opening in the sleeve 302, which movement causes the arms to close upon the inner conductor 1002 and seize the inner conductor. After seizing the inner conductor 1002, the arms 311–314 make mechanical and electrical contact with the inner conductor and securely hold the inner conductor to the connector 200. Further movement of the coaxial cable 1000 into the connector 200 is stopped when the outer conductor 1006 of the coaxial cable strikes the front compression ring 316. FIG. 7 shows the coaxial cable 1000 fully inserted into the connector 200.

Figure 15:
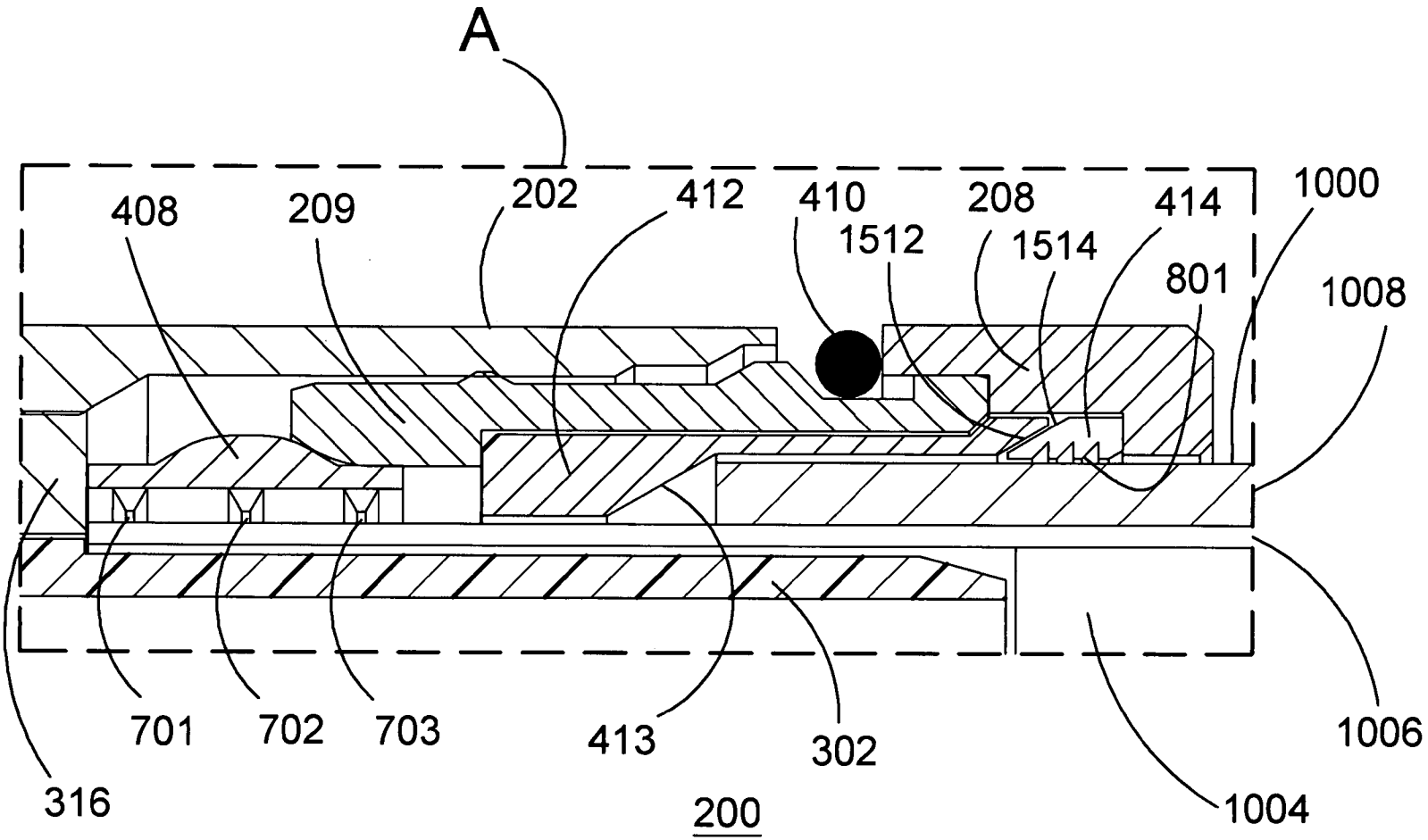
FIG. 15 is an enlargement of area A of FIG. 7.

It should be noted that after the third step, the contact 306 protrudes from the front end 204 of the connector 200, whereas, prior to the third step, the contact preferably did not protrude from the front end. The protrusion of the contact 306 from the front end 204 of the connector 200 is an indication to the person performing the attachment that the arms 311–314 of the contact have securely grasped the inner conductor 1002 of the coaxial cable 1000. The ferrule 408 has three (3) rings of teeth 701–703 on a radially inward facing surface, which are for making mechanical and electrical contact with, and for holding and securing, the outer conductor 1006 of the coaxial cable 1000 to the connector 200. FIG. 13 is an enlarged view of the ferrule 408. It should be noted that in FIG. 7, the three (3) rings of teeth 701–703 of the ferrule 408 are not holding or securing the outer conductor 1006. FIG. 15 is an enlargement of area A of FIG. 7.

Although the insertion of the coaxial cable 1000 into the connector 200 was described as occurring in separate second and third steps for purposes of illustration, in practice, the insertion of the coaxial cable into the connector could take place as one continuous step.

Figure 8:
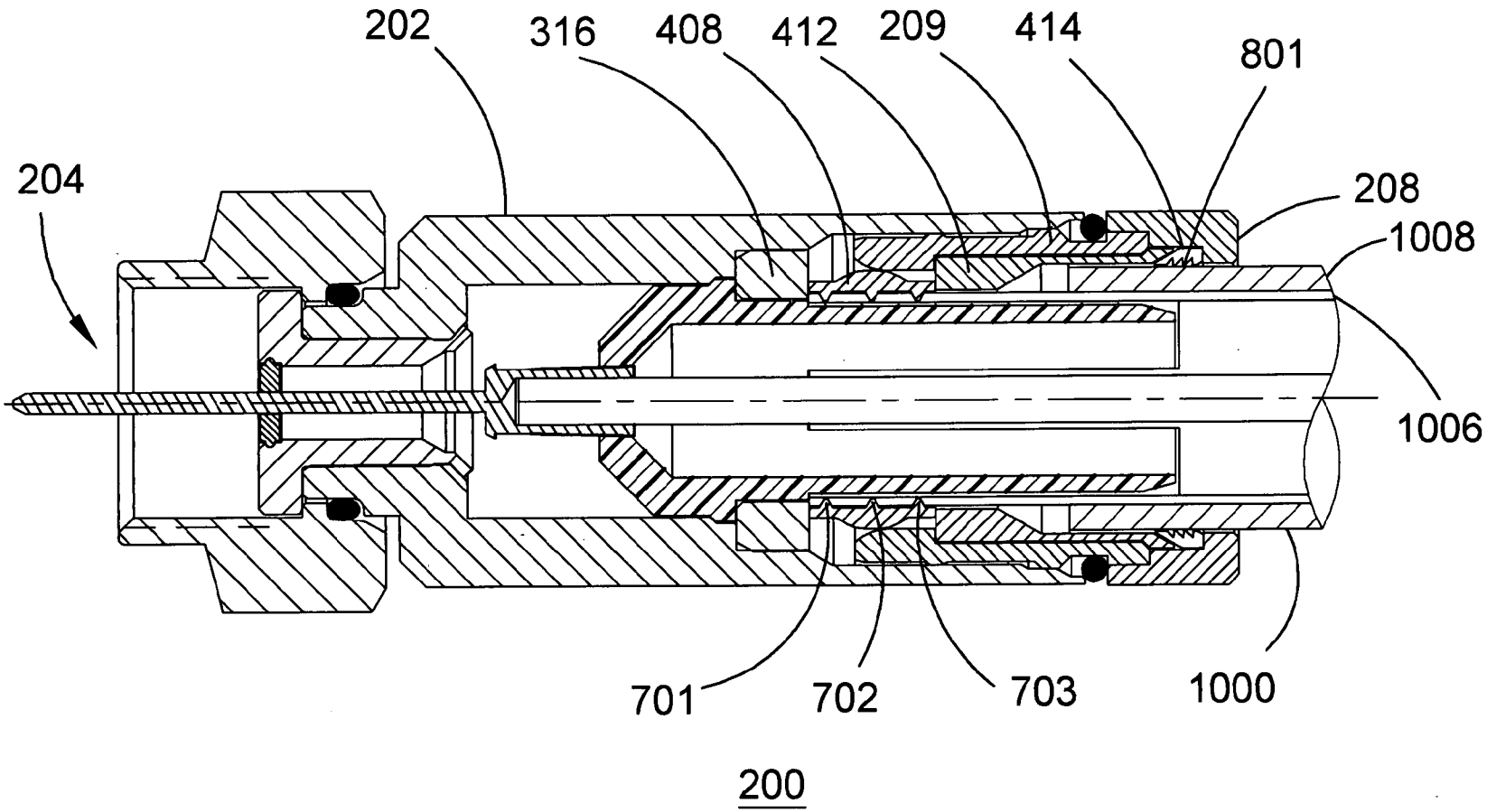
FIG. 8 is a cross-sectional view along cut-line X—X of the connector of FIG. 2, including a cross-sectional view of the hardline coaxial cable fully inserted into the connector, showing the connector partially compressed.

Referring now to FIG. 8, a final step in the attachment of the connector 200 to the coaxial cable 1000 is to use a standard, hand—held compression tool to compress the connector. Preferably, one of a CablePrep® model PT-5000UNV-711 compression tool and a Cablematic® model CAT 711 compression tool is used. Alternatively, the compression tool similar to the one described in U.S. Pat. No. 5,647,119 is used. As the compression tool axially compresses the connector 200, first, the outer conductor 1006 of the coaxial cable 1000 is secured to the connector 200 by the ferrule 408. Then, advantageously only subsequent to the outer conductor 1006 being secured, is the jacket 1008 secured by the gripping member 414, as more fully explained hereinbelow. Note that in the cross-sectional views of the drawings, the gripping member 414 is represented without any hatching because of its small size. FIG. 14 is an enlargement of the perspective view of the gripping member 414 shown in FIG. 4.

As the compression tool compresses the connector 200, the compression can 208 and the body 202 are moved toward each other from the uncompressed position as shown in FIGS. 2, 3, 5, 6 and 7, to a partially compressed position as shown in FIG. 8. As the compression can 208 and the body 202 move together, the compression can 208 causes the rear compression ring 209 to move axially (relative to the body) toward the front end 204 of the connector 200. As the rear compression ring 209 moves toward the front end 204 of the connector, a ramped surface 509 on a radially inward side of the rear compression ring near the front end of the rear compression ring slides over a protruding surface 508 on a radially outward side of the ferrule 408. The ferrule 408 is prevented from moving toward the front end 204 of the connector 200 by the front compression ring 316 and the by body 202. As the ramped surface 509 on the radially inward side of the rear compression ring 209 slides over the protruding surface 508 of the ferrule 408, the ferrule is moved radially inward toward the bared outer conductor 1006 of the coaxial cable 1000. Preferably, the ferrule 408 has a c-shaped cross-section to facilitate radially inward movement. As the ferrule is moved radially inward toward the bared outer conductor 1006 of the coaxial cable 1000, the three (3) rings of teeth 701–703 of the ferrule 408 make mechanical and electrical contact with the outer conductor 1006 of the coaxial cable 1000. FIG. 8 shows the connector 200 partially compressed and the three (3) rings of teeth 701–703 of the ferrule 408 biting into the outer conductor 1006 of the coaxial cable 1000, thereby making mechanical and electrical contact with the outer conductor, and consequently holding and securing the outer conductor to the connector.

As the compression can 208 and the body 202 are moved together, the compression can 208 also axially moves the gripping member 414, which, in turn, causes the actuator 412 to move axially (relative to the body) toward the front end 204 of the connector 200. The actuator 412 travels forward with the rear compression ring 209 until the actuator contacts the ferrule 408, at which juncture the actuator stops moving forward, but the rear compression ring may continue to move forward. FIG. 8 shows that the front end of the actuator 412 is abutting the ferrule 408, and that the gripping member 414 is abutting the back end of the compression can 208. Note, however, that in FIG. 8, the actuator 412 is not abutting the compression can 208. The gripping member 414 has a plurality 801 of teeth on a radially inward facing surface. It should be noted that in FIG. 8, the plurality 801 of teeth of the gripping member 414 is not holding or securing the jacket 1008 of the coaxial cable 1000.

Figure 9:
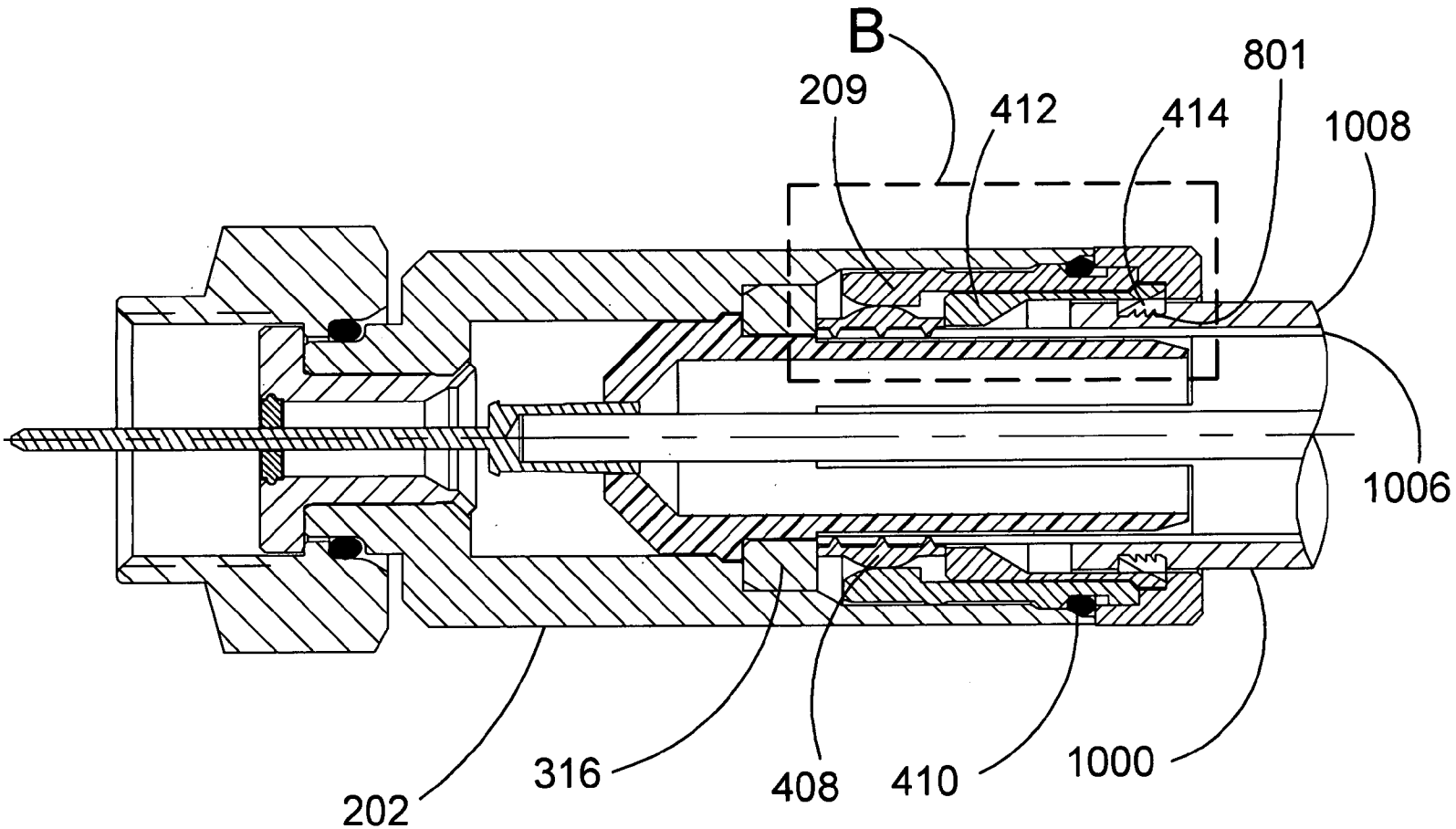
FIG. 9 is a cross-sectional view along cut-line X—X of the connector of FIG. 2, including a cross-sectional view of the hardline coaxial cable fully inserted into the connector, showing the connector fully compressed.

Referring now to FIG. 9, as the compression can 208 and the body 202 continue to move together (beyond the position shown in FIG. 8) due to use of the compression tool, the rear compression ring 209 continues to move (relative to the body) toward the front end 204 of the connector 200; however, the rear compression ring merely slides over the ferrule 408 without pressing it any further into the outer conductor 1006.

Figure 16:
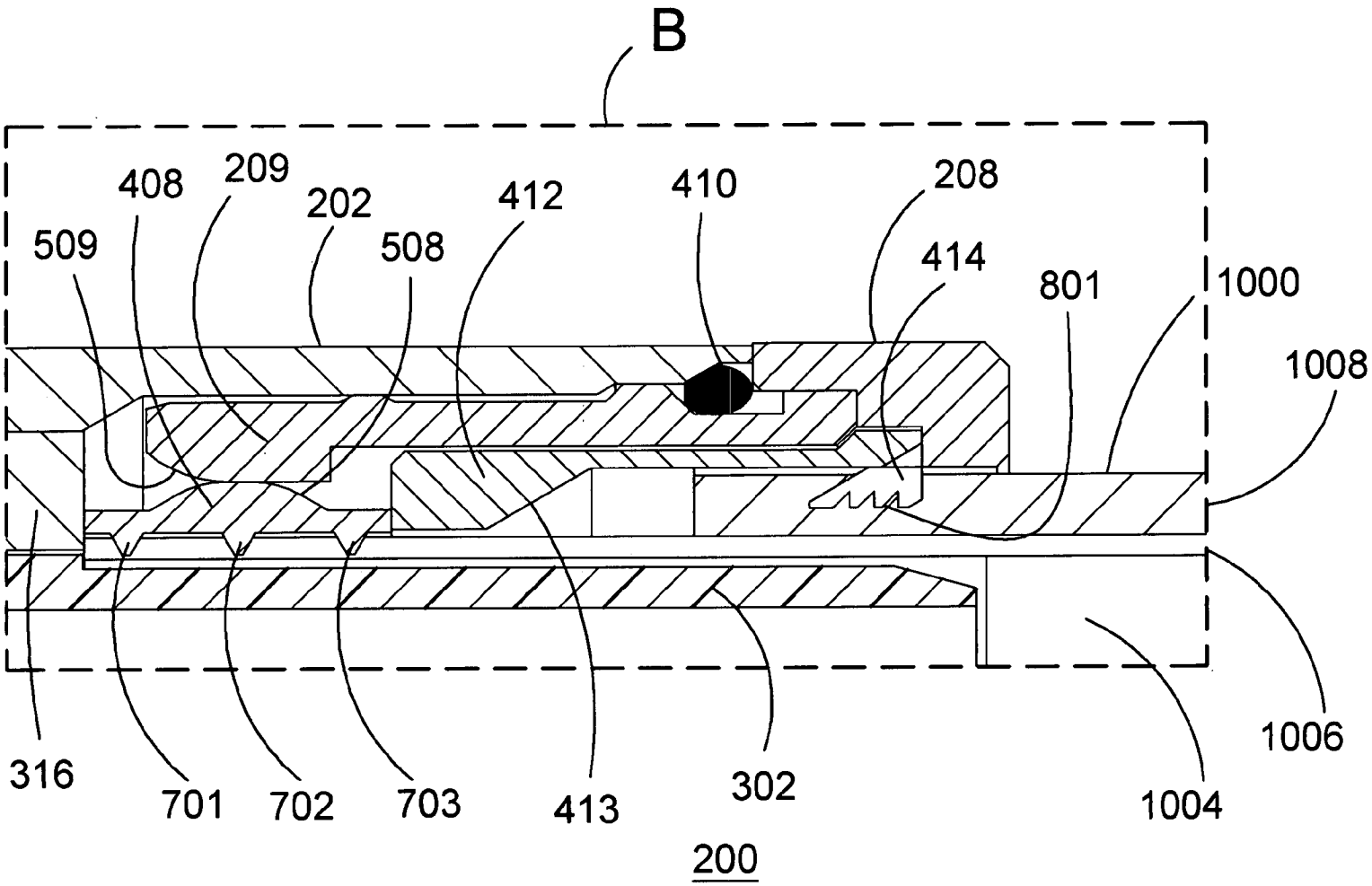
FIG. 16 is an enlargement of area B of FIG. 9.

The actuator 412 has a small ramp 1512 (see FIG. 15), which is preferably at an angle of about 45° (relative to the axis of the connector 200), and which is located at the back side of the actuator. The gripping member 414 has a small ramp 1514 (see FIG. 15) preferably having an angle of about 135° (relative to the axis of the connector 200), which is located at the front side of the gripping member, and which abuts the small ramp 1512 of the actuator 412. As the compression can 208 continues to move toward the body 202 (beyond the position shown in FIG. 8), the gripping member 414 is pushed toward the actuator 412 by the compression can, which movement causes the gripping member to slide across a back portion of the actuator (facilitated by the slidable mating of their respective small ramps); as a result, the gripping member moves radially inward. The movement of the gripping member 414 radially inward toward the jacket 1008 of the coaxial cable causes the plurality of teeth 801 of the gripping member to bite into the jacket, thereby securely holding the coaxial cable 1000 to the connector 200. It is advantageous that axial movement of the coaxial cable 1000 relative to the connector 200 is minimal and substantially absent at the moment that the gripping member 414 grips the jacket of the coaxial cable, because the lack of axial movement produces a more secure grip. Movement of the cable 1000 and the connector 200 (relative to each other) is restricted by the previous engagement of the ferrule 408 onto the outer conductor 1006. FIG. 9 shows the connector 200 fully compressed, and that the rear O-ring 410 is sealing the interior of the connector at the junction between the body 202 and the compression can 208. FIG. 9 shows the completed attachment between the coaxial cable 1000 and the connector 200. As explained hereinabove, the connector 200 includes means for seizing the outer conductor 1006 prior to gripping the jacket 1008. By seizing the outer conductor 1006 and gripping the jacket 1008 at different moments, i.e., sequentially, the connector 200 is advantageously easier to compress than when seizing the outer conductor 1006 and gripping the jacket 1008 at the same moment, i.e., simultaneously, as occurs with known prior art connectors. In other words, the seizing the outer conductor 1006 and gripping the jacket 1008 occur at different axial positions of the compression can (relative to the body) rather than at the same position, as occurs with known prior art connectors. Alternatively, at least one of the aforementioned advantages of the invention would also be attained if the outer conductor 1006 is seized subsequent to the gripping of the jacket 1008. FIG. 16 is an enlargement of area B of FIG. 9.

Figure 10:
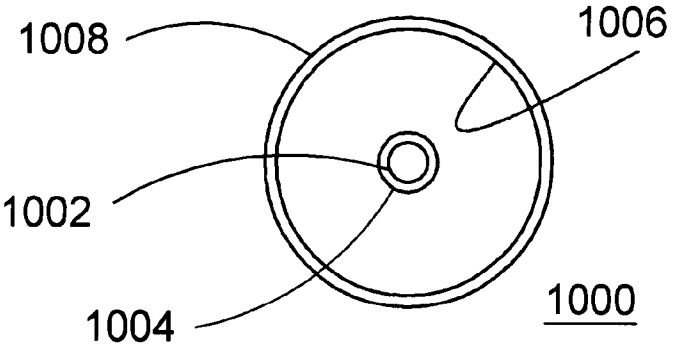
FIG. 10 is a simplified representation of an end view of a terminating end of a hardline coaxial cable after being ideally prepared for insertion into a connector.

FIG. 10 is a simplified representation of an end view of a terminating end of the coaxial cable 1000 after being ideally prepared for insertion into the connector 200, showing no deformation of the end of the outer conductor 1006.

Figure 11:
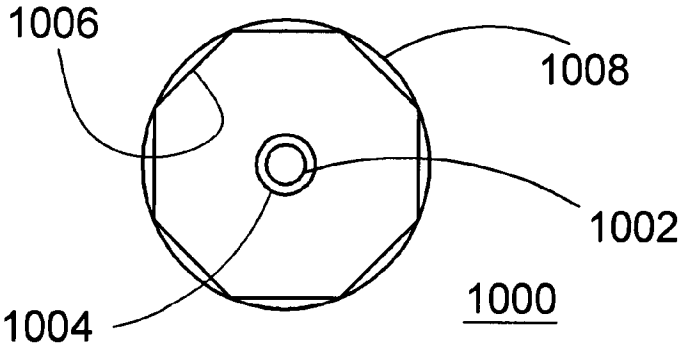
FIG. 11 is a simplified representation of an end view of a terminating end of a hardline coaxial cable after being prepared for insertion into a connector, showing a first type of deformation of the outer conductor of the hardline coaxial cable.

FIG. 11 is a simplified representation of an end view of the terminating end of the coaxial cable 1000 after being prepared for insertion into the connector 200, showing a first type of deformation of the outer conductor 1006 at the terminating end of the coaxial cable 1000, which is the forming of a slight octagonal shape to the end of the outer conductor, which sometimes occurs while using a first type of coring tool. Note that the octagonal shape to the end of the outer conductor is exaggerated in FIG. 11 for purposes of illustration.

Figure 12:
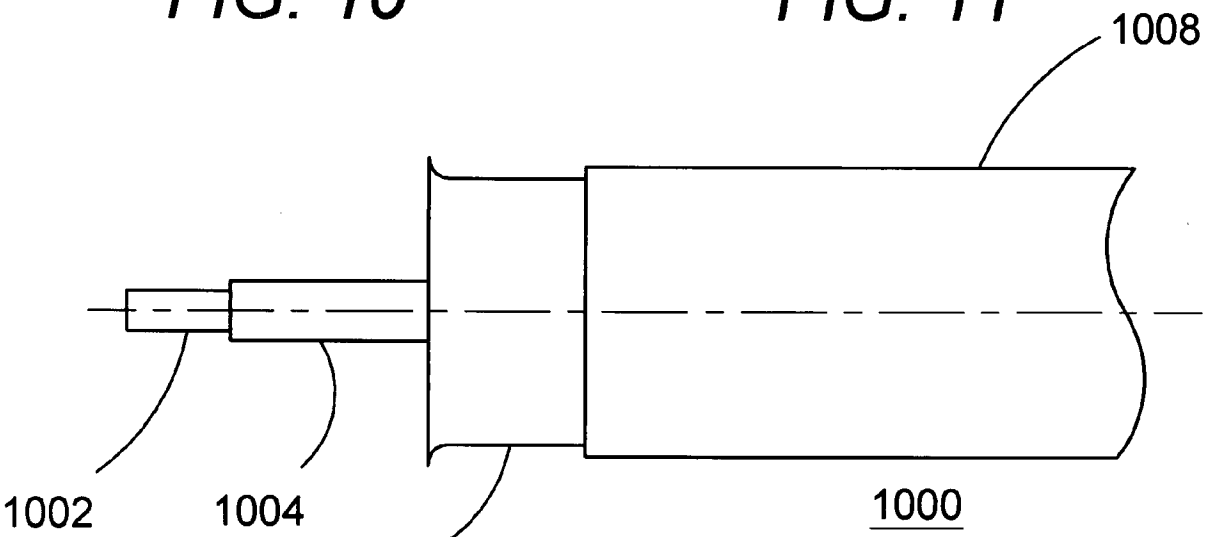
FIG. 12 is a simplified representation of a side view of a terminating end of a hardline coaxial cable after being prepared for insertion into a connector, showing a second type of deformation of the outer conductor.

FIG. 12 is a simplified representation of a side view of the terminating end of the coaxial cable 1000 after being prepared for insertion into the connector 200, showing a second type of deformation of the outer conductor 1006 at the terminating end of the coaxial cable 1000, which is a flaring of the outer conductor, or slight increase in the diameter of the outer conductor at its end, which sometimes occurs while using a second type of coring tool. Note that the flaring of the outer conductor 1006 is exaggerated in FIG. 12 for purposes of illustration. Prior art compression style connectors for hardline coaxial cable have difficulty accepting insertion of a coaxial cable that has one or both of the types of deformation of the outer conductor shown in FIGS. 11 and 12.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

LIST OF REFERENCE NUMERALS

100 Prior art connector
200 Connector
202 Body
204 Front end
206 Back end
208 Compression can
209 Rear compression ring
210 Coupling nut
302 Sleeve
306 Contact
311–314 Arms
316 Front compression ring
402 Insulator
404 Nut retainer
406 Front O-ring
408 Ferrule
410 Rear O-ring
412 Actuator
413 Angled surface
414 Gripping member
508 Protruding surface
509 Ramped surface
701–703 Rings of teeth of the ferrule
801 Plurality of teeth of the gripping member
1000 Coaxial cable
1002 Inner conductor
1004 Dielectric
1006 Outer conductor
1008 Jacket
1512 Small ramp of actuator
1514 Small ramp of gripping member

We claim:

1. A connector for terminating the end of a coaxial cable, the coaxial cable having an inner conductor, an outer conductor, and an outer insulating jacket, the connector comprising:

a. a substantially cylindrical body having an axis and having a front end and a back end;

b. a coupling nut rotatably connected to the body at the front end of the body;

c. a compression can axially movably connected to the body at the back end of the body between an uncompressed axial position and a fully-compressed axial position relative to the substantially cylindrical body;

d. means for contacting the inner conductor of the coaxial cable;

e. means for seizing the outer conductor of the coaxial cable, the seizing means seizing the outer conductor of the coaxial cable when the compression can has advanced to a partially-compressed axial position, the compression can reaching the partially-compressed axial position before reaching the fully-compressed axial position; and f. means for gripping the insulating jacket of the coaxial cable, the gripping means gripping the insulating jacket of the coaxial cable after the compression can advances beyond the partially-compressed axial position toward the fully-compressed position, wherein the seizing of the outer conductor and the gripping of the insulating jacket occur sequentially during compression together of the body and of the compression can after insertion of the termination end of the coaxial cable into the connector.

2. The connector recited by claim 1 wherein the seizing of the outer conductor occurs prior to the gripping of the insulating jacket.

3. The connector recited by claim 1 wherein the seizing of the outer conductor and the gripping of the insulating jacket occur at difference axial positions of the compression can relative to the body.

4. A connector for attachment to the end of a coaxial cable, the coaxial cable having an inner conductor surrounded by a dielectric, the dielectric being surrounded by an outer conductor, the outer conductor being surrounded by a jacket, the connector being generally cylindrical and having an axis, the connector comprising:

a body having a front end and a back end;

a coupling nut rotatably connected to the body at the front end of the body;

a contact disposed within the body for contacting the inner conductor of the coaxial cable;

a sleeve fixedly mounted within the body a ferrule disposed within the body and surrounding a portion of the sleeve, wherein the ferrule is configured to contact the outer conductor of the coaxial cable;

a compression can axially movably connected to the body at the back end of the body;

an actuator at least partially disposed within the body and at least partially disposed within the compression can, wherein the compression can and the actuator are axially movable relative to the body between an uncompressed state and a partially compressed state;

wherein the compression can is axially movable in a first direction relative to the body between the partially compressed state and a fully compressed state, and wherein the actuator is axially movable relative to the body in a second direction between the partially compressed state and the fully compressed state, wherein the second direction is opposite to the first direction.

5. A connector for attachment to the end of a coaxial cable, the coaxial cable having an inner conductor surrounded by a dielectric, the dielectric being surrounded by an outer conductor, the outer conductor being surrounded by a jacket, the connector being generally cylindrical and having an axis, the connector comprising:

a body having a front end and a back end;

a coupling nut rotatably connected to the body at the front end of the body;

a contact disposed within the body for contacting the inner conductor of the coaxial cable;

a sleeve fixedly mounted within the body a ferrule disposed within the body and surrounding a portion of the sleeve, wherein the ferrule is configured to contact the outer conductor of the coaxial cable;

a compression can axially movably connected to the body at the back end of the body;

an actuator at least partially disposed within the body and at least partially disposed within the compression can, wherein the compression can and the actuator are axially movable relative to the body between an uncompressed state and a partially compressed state;

wherein the compression can and the actuator are axially movable in a first direction relative to the body between the uncompressed state and the partially compressed state, wherein the compression can is axially movable in the first direction relative to the body between the partially compressed state and a fully compressed state, and wherein the actuator is axially movable relative to the body in a second direction between the partially compressed state and the fully compressed state, wherein the second direction is opposite to the first direction.

* * * * *